United States Patent [19]

Heinrich

[11] Patent Number: 4,464,987

[45] Date of Patent: Aug. 14, 1984

[54] REFUSE COMPACTING AND TRANSPORTING SYSTEM

[76] Inventor: Richard J. Heinrich, Rte. 3, Box 452, Staunton, Va. 24401

[21] Appl. No.: 537,034

[22] Filed: Sep. 29, 1983

[51] Int. Cl.[3] ..... B30B 15/30

[52] U.S. Cl. ..... 100/215; 100/229 A; 100/245; 141/73; 141/364

[58] Field of Search ..... 100/215, 229 A, 245; 141/73, 80, 364, 365; 414/293, 680; 222/160

[56] References Cited

U.S. PATENT DOCUMENTS

| | | | |
|---|---|---|---|
| 2,744,670 | 5/1956 | Bendot | 222/166 X |
| 2,984,174 | 5/1961 | Jones | 100/215 X |
| 3,250,414 | 5/1966 | Pioch | 100/229 A |
| 4,149,457 | 4/1979 | Smith | 100/215 X |
| 4,230,037 | 10/1980 | Schmalz | 100/215 X |
| 4,289,068 | 9/1981 | Heinrich | 100/215 |

FOREIGN PATENT DOCUMENTS

| | | | |
|---|---|---|---|
| 1938150 | 2/1971 | Fed. Rep. of Germany | 100/215 |
| 577379 | 7/1976 | Switzerland | 100/229 A |
| 632582 | 11/1978 | U.S.S.R. | 100/215 |

*Primary Examiner*—Billy J. Wilhite

*Attorney, Agent, or Firm*—B. P. Fishburne, Jr.

[57] ABSTRACT

Refuse delivered into an elevatable pivoted dumping bin is transferred by gravity and by the operation of a positive pusher element into a hopper bin above and in communication with a horizontal axis ram compactor. The hopper bin/ram compactor unit is interfaced with a large volume refuse transporting container which is removed to a refuse dumping site periodically. The system is capable of on-site operation for extended periods of time with minimal operator attendance. The system assures a substantially trash-free environment.

7 Claims, 13 Drawing Figures

REFUSE COMPACTING AND TRANSPORTING SYSTEM

BACKGROUND OF THE INVENTION

The instant invention is an improvement on a dump compactor for refuse disclosed in U.S. Pat. No. 4,289,068, issued Sept. 15, 1981, and on similar prior art equipment.

The apparatus of the prior patent, while commercially successful, possesses certain deficiencies which the present invention fully overcomes. In the patented apparatus, gravity alone is relied upon in the transfer of refuse from a pivoted elevatable dumping bin into a receiver or hopper bin which is in communication with an underlying horizontal axis ram compactor. In the present invention, as one of its main improvement features, the refuse in the dumping bin is delivered into the hopper bin by the combined action of gravity and a positive refuse pusher plate on the outlet end of the dumping bin. The positive pushing operation not present in the prior art is made possible by a simple forward displacement and relocation of the pivot axis for the dumping bin, and the utilization of a unique yoke-type hinge structure for the dumping bin. Without the positive pushing feature of the present invention, there is a tendency for some refuse not to clear the dumping bin and to be lodged in the scissoring region between the dumping and hopper bins, and sometimes escapes from the apparatus, resulting in littering of the adjacent area, such as a large apartment complex.

As a further environmental protection feature of the invention absent in the prior patent, hinged deflector plates or shields of triangular construction carried by the dumping bin operate within gaps in the scissoring zones between the dumping and hopper bins, and these deflector shields remain in sliding contact with the hopper bin walls due to gravity or spring-biasing and assure a clean transfer of refuse from the dumping bin to the hopper bin.

A further improvement over the prior patented structure resides in shielding of the attachment points for the dumping bin elevating rams, for safety, obstruction-free operation, and appearance. The mounting brackets for the dumping bin hydraulic elevating rams on the compactor unit have also been simplified for ease of manufacturing and for better anchorage of the ram cylinders.

Other improvement features and advantages over the prior art will be apparent to those skilled in the art during the course of the following detailed description.

DETAILED DESCRIPTION

Figure 1:
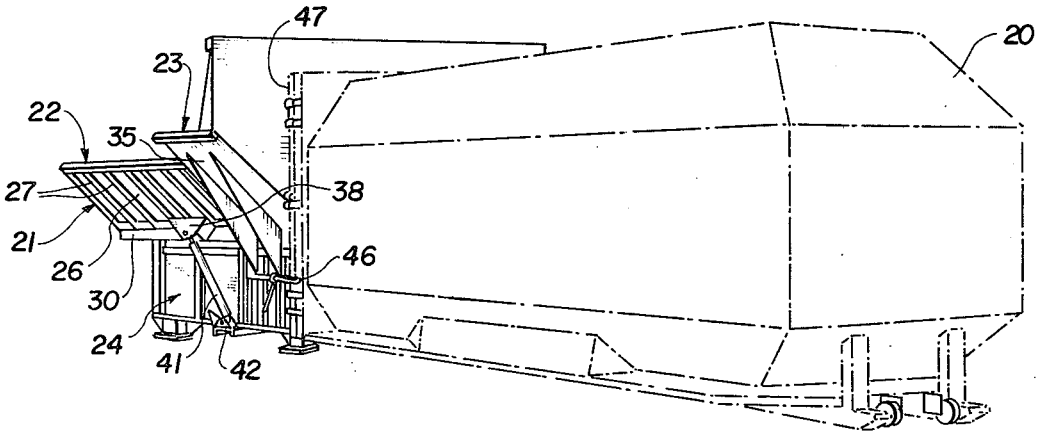
FIG. 1 is a perspective view of a refuse compacting and transporting system according to the present invention.
Figure 2:
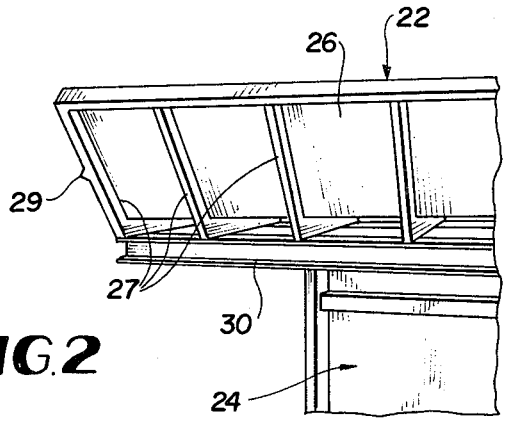
FIG. 2 is a fragmentary perspective view showing particularly the construction of the dumping bin cradle supports and associated elements.
Figure 3:
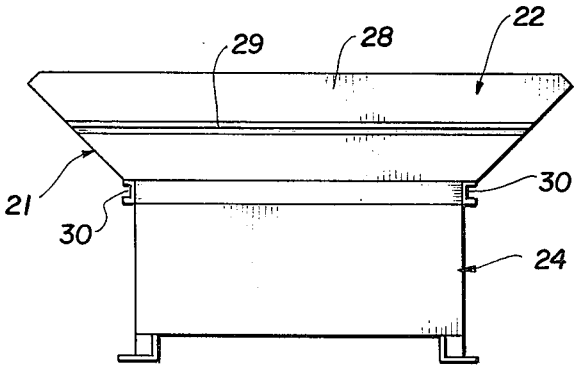
FIG. 3 is a rear end elevation of the apparatus showing the dumping pin at rest horizontally on the compacting unit.

Referring to the drawings in detail, wherein like numerals designate like parts, a refuse compacting and transporting system in its entirety is shown in FIG. 1. The system includes a large volume refuse receiving and transporting container 20 of conventional construction which is comparable in size to a semitrailer body. After becoming filled with refuse at a particular location, the container is readily movable to a main dumping site.

As shown in FIG. 1, the transporting container 20 is interfaced releasably with a refuse receiving, dumping and compacting apparatus 21 forming the main subject matter of the present invention and possessing the substantial improvements over the structure disclosed in prior U.S. Pat. No. 4,289,068. In general the apparatus 21 is similar to the patented apparatus, and the disclosure in the prior patent is incorporated by reference herein to simplify the present detailed description and to enable emphasis to be placed on the improvements.

The apparatus 21 consists of three main components, namely, a refuse dumping bin 22, a hopper bin or receiver 23, and an underlying horizontal axis ram compactor unit 24, arranged one relative to the other generally as described in the referenced patent.

A very important improvement feature of this invention contributing to an improved mode of operation consists of the movement forwardly on the apparatus 21 of the transverse axis pivot 25 for the dumping bin 22 compared to its position in the prior patent. In a full size commercial apparatus, the pivot axis for the dumping bin has been displaced forwardly approximately fourteen inches while remaining substantially at the same elevation. This relocation of the pivot axis 25 enables the utilization of a yoke-type pivoting and elevating means for the dumping bin 22 which in turn enables a positive pushing action on the refuse being transferred from the dumping bin 22 to the hopper bin 23, with the assistance of gravity. This positive pushing or displacement of the refuse was lacking in the prior patented structure and is an important feature contributing to the complete transfer of refuse from the dumping bin to the hopper bit without spilling any of the refuse onto the surrounding area.

More particularly, the dumping bin 22 according to this invention includes sloping upwardly divergent side walls 26 in contrast to vertical side walls on the dumping bin in the referenced prior patent. These sloping side walls are firmly supported by a series of longitudinally spaced supporting cradle braces 27 which extend transversely of the dumping bin across its bottom and across its two sloping side walls. The rear vertical wall 28 of dumping bin 22 is preferably reinforced for the sake of rigidity by a transverse horizontal angle brace 29 in accordance with another improvement feature of the invention.

The bottoms of the supporting cradle braces 27 are welded to a pair of sturdy longitudinal parallel channel members 30 whose forward end portions project somewhat forwardly of the dumping bin 22 to form hinge yoke arms 31. These yoke arms 31 lie inwardly of fixed upstanding pivot brackets 32 on the side walls of compactor unit 24, and the yoke arms 31 and brackets 32 are pivotally connected on each side of the apparatus by two pivot elements 25 defining the aforementioned pivot axis of the dumping bin.

Figure 5:
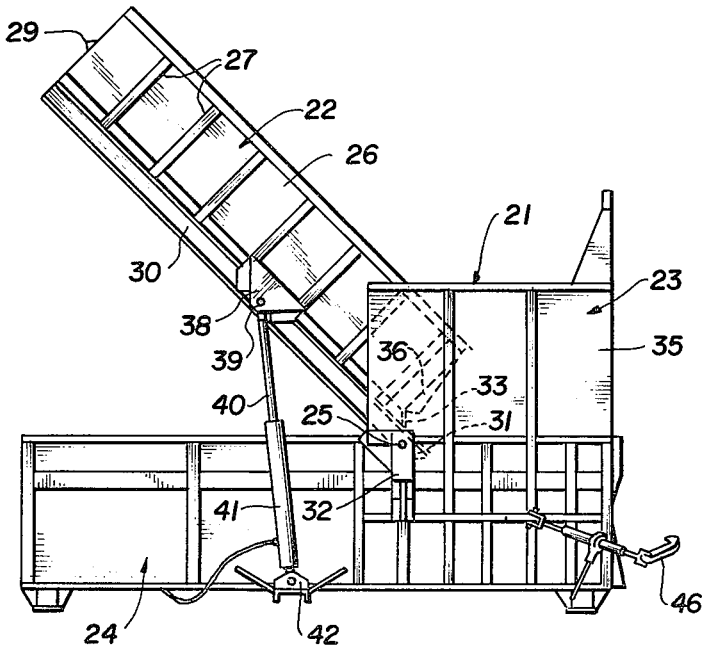
FIG. 5 is a further side elevation of the apparatus with the dumping bin elevated.
Figure 6:
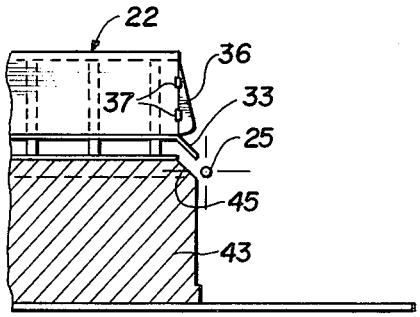
FIG. 6 is a fragmentary side elevational view, partly in section and partly schematic, showing the dumping bin in a level position relative to the compactor ram and showing the location of the dumping bin pivot axis.
Figure 7:
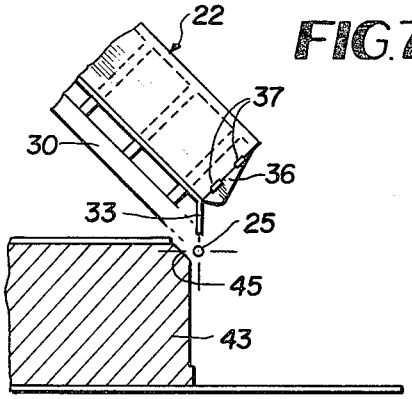
FIG. 7 is a similar view showing the dumping bin in the elevated inclined position.
Figure 8:
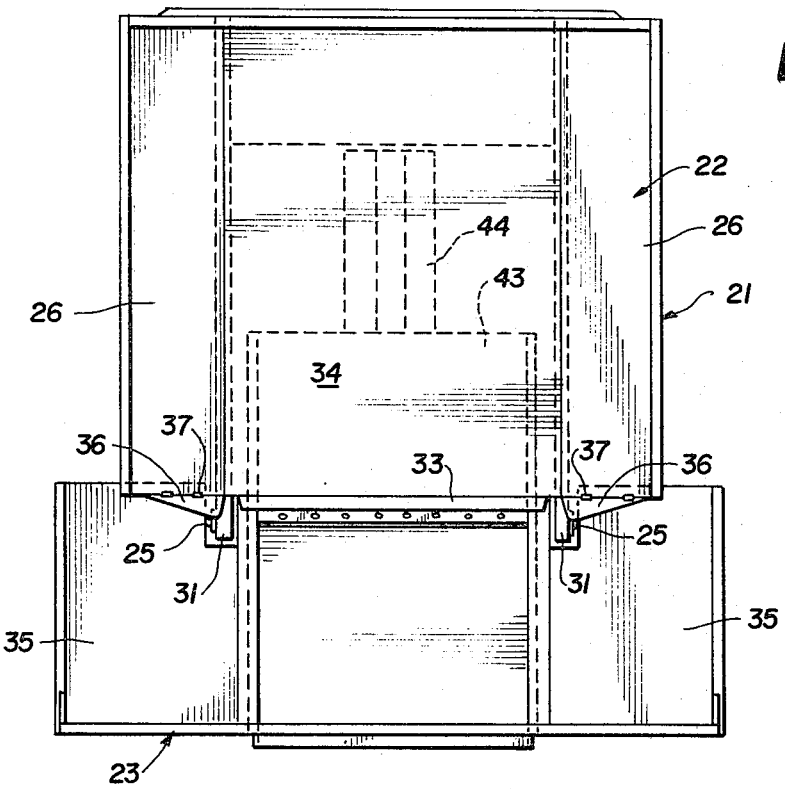
FIG. 8 is a plan view of the apparatus as shown in FIG. 4.
Figure 9:
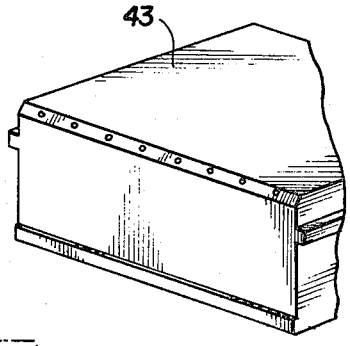
FIG. 9 is a fragmentary perspective view of the refuse compacting ram.
Figure 10:
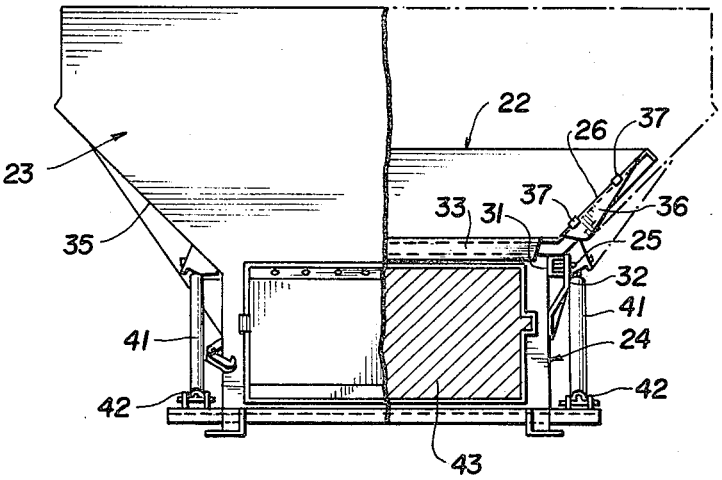
FIG. 10 is a front elevational view of the apparatus as shown in FIGS. 4 and 8, partly broken away and partly in vertical section.

A dumping bin refuse pusher plate or lip 33 is provided across the forward edge of the flat bottom wall 34 of dumping bin 22. With reference to FIGS. 6 and 7 and also FIG. 5, it can be seen that when the dumping bin 22 is raised to a steep inclined dumping position to discharge its content into the relatively stationary hopper bin 23, the refuse pusher plate 33 moves in an arc upwardly and forwardly and around the pivot axis defined by the pivot elements 25, from the position shown in FIG. 6 to the position shown in FIG. 7, where the pusher plate 33 is vertical and above the dumping bin pivot axis to push or force the refuse last exiting the dumping bin positively into the hopper bin 23. This positive action is made possible by the described yoke-type hinge for the dumping bin not known in the prior art. Furthermore the strength of the dumping bin 22 has greatly been increased by the arrangement of the cradle braces 27 spanning the dumping bin and being welded to the two channel members 30. The plate or lip 33 in effect elevates the refuse being discharged from the dumping bin and pushes it into the hopper bin 23, thereby eliminating spilling of excess refuse. There is no single continuous pivot element extending across the void of the hopper bin 23 to interfere with the smooth entry of refuse into it. The two side pivot elements 25 are entirely outside of the void of the hopper bin.

Figure 4:
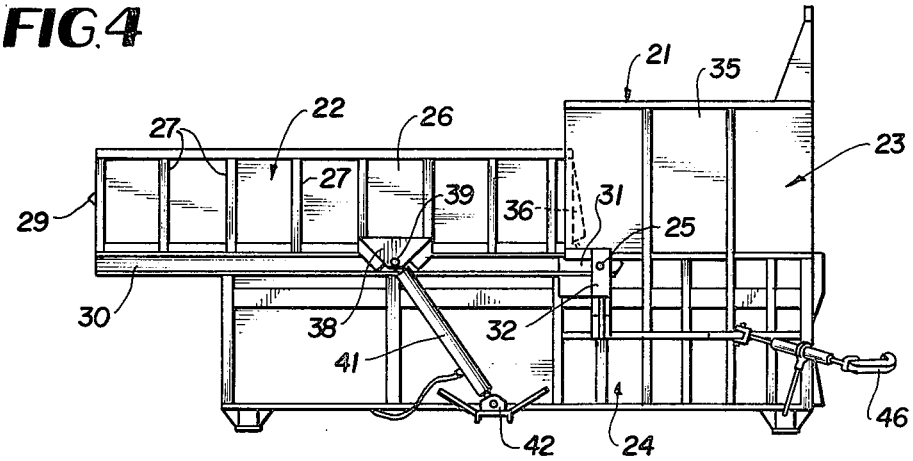
FIG. 4 is a side elevation of the apparatus as shown in FIG. 1 without the refuse transporting container.
Figure 11:
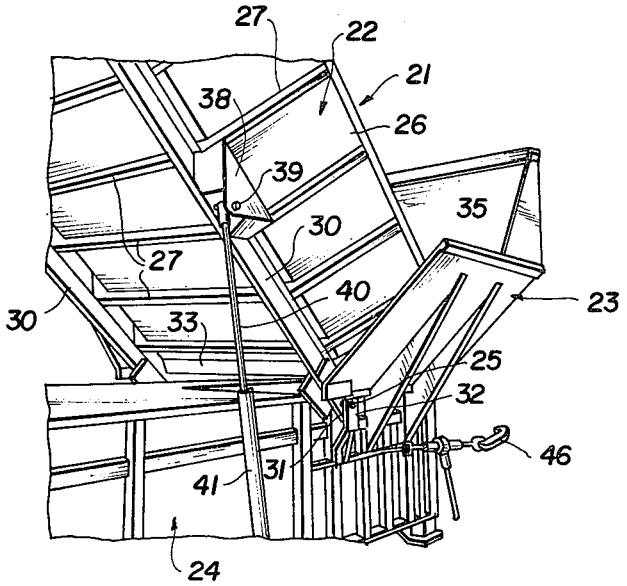
FIG. 11 is a fragmentary perspective view of the apparatus in the refuse transferring mode and depicting the scissoring action of the side walls of the dumping and hopper bins.
Figure 12:
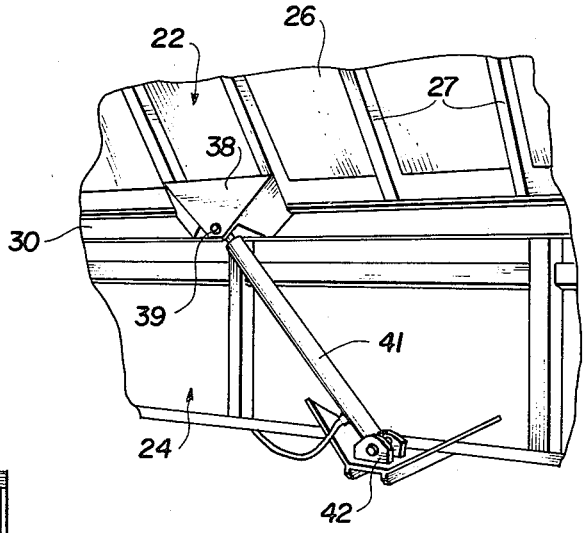
FIG. 12 is a fragmentary perspective view of the apparatus showing particularly the support structure for the dumping bin operating rams.
Figure 13:
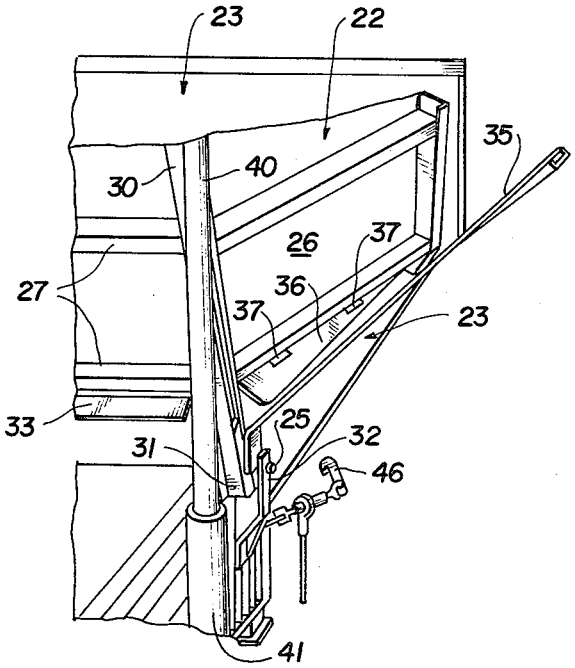
FIG. 13 is a fragmentary perspective view similar to FIG. 11 but at a different viewing angle to depict the relationship of the dumping bin and hopper bin side walls and the hinged deflector shields which fill the triangular voids between these side walls during the dumping mode.

In the present invention, the side walls 35 of the hopper bin 23 are also steeply inclined and upwardly divergent for increased refuse capacity, and the walls 35 are parallel to the side walls 26 of the dumping bin 22 when the latter bin is in a level non-dumping position at rest on the compactor unit 24, FIGS. 1 and 4. The side walls 35 lie laterally outwardly of the side walls 26, as shown. When the dumping bin 22 is raised to its dumping position, FIGS. 5 and 11, the side walls 26 and 35 are no longer parallel, but assume a compound angular relationship best shown in FIG. 13 with two spaces or voids between them on each side of the apparatus, which spaces change in size as the angular position of the dumping bin 22 changes. The two spaces are roughtly triangular in formation, FIG. 13.

According to an important improvement feature of this invention, self-adjusting triangular deflector plates 36, one on each side of the apparatus, lie in the gaps between the overlapping side walls 26 and 35 and are hinged at 37 to the forward edges of the dumping bin side walls. These deflector plates remain in sliding contact with the hopper bin side wall interior surfaces during the refuse dumping operation, and adjust their positions automatically by gravity as the dumping bin 22 moves relative to the hopper bin 23. The deflector plates 36 serve to advance refuse along the two side walls of the hopper bin in the scissoring zone between the two bins during the refuse transfer operation and preclude spilling of refuse which might otherwise occur. Like the pusher plate 33, the two deflector plates 36 contribute to a complete and clean transfer of refuse from the bin 22 to the bin 23.

In accordance with further improvements over the referenced prior patent, the brackets 38 on the opposite sides of the dumping bin 22 are of the enclosed or shielded type with relation to their pivotal connections at 39 with the rods 40 of the two hydraulic rams 41 which raise and lower the dumping bin 22. Additionally, the lower mounting brackets 42 for the rams 41 have been simplified for ease of manufacturing and made more rigid. These brackets 42 are fixed to the base of compactor unit 24 generally as in the prior patent.

The compacting unit 24 remains basically as described in the referenced patent except for the relocation on it of the dumping bin pivot elements 25. The overall mode of operation of the apparatus 21 remains essentially as described in U.S. Pat. No. 4,289,068 and need not be repeated. The horizontal axis compacting ram 43 is powered by cylinder means 44 within the rear portion of the unit 24 and beneath dumping bin 22. It can be noted in FIG. 7 that the depending pusher plate 33 is above the top face of ram 43 and does not interefere with movements of the latter. The forward upper corner 45 of the ram 43 is beveled to clear the plate 33 when the dumping bin 22 is level, FIG. 6.

As in the prior patent, coupling hooks 46 are provided on the forward end of unit 24 to releasably secure the apparatus 21 in coupled relationship to the large transport container 20 which has an opening in registration with the outlet of the unit 24 whereby the ram 43 can force refuse into the container 20 on a continuing basis. When the large container 20 is finally filled with compacted refuse, the coupling means 46 is released and doors 47, FIG. 1, on the container 20 are closed, whereby the transport container can be moved to a dump site without spilling refuse.

The several important advantages of the refuse compacting apparatus according to the present invention over the prior art should now be readily apparent to those skilled in the art.

It should be mentioned that, in some cases, it may be desirable to utilize biasing springs with the gravity operated deflector plates 36, although it is contemplated that ordinarily springs will not be necessary.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A refuse compacting and transporting system comprising a receiving, dumping and compacting apparatus added to be releasably coupled to a large capacity refuse transporting container, said apparatus comprising a horizontal axis ram compacting unit forming a base for the apparatus and having releasable means for coupling the apparatus to a large capacity refuse transporting container, a hopper bin mounted on a forward portion of said compacting unit and being in communication through its bottom therewith and having an open rear end and sloping upwardly divergent side walls, a dumping pin above the rear portion of the compacting unit and extending rearwardly of the hopper bin and having a forward open end and sloping upwardly divergent side walls which are parallel to the side walls of the hopper bin when the dumping pin in a substantially level position resting on the compacting unit, a transverse axis yoke hinge for the dumping bin on the compacting unit substantially at the top of the compacting unit and spaced a substantial distance forwardly of the rear open end of the hopper bin, whereby the side walls of the dumping bin and hopper bin may have scissoring action with the dumping bin entering between the hopper bin side walls when the dumping bin is elevated to a dumping position, power means coupled between the dumping bin and compacting unit to raise and lower the dumping bin around its pivot axis, a depending refuse pusher plate on the bottom and forward end of the dumping bin transversely thereof having an arcuate path of movement around the pivot axis of the dumping bin in spaced relationship to the pivot axis, the side walls of the dumping bin and hopper bin being in nonparallel gapped relationship when the dumping bin is in an elevated dumping position, and refuse deflector plates hinged to the side walls of the dumping bin at the forward end of the dumping bin and having edges which remain wipingly engaged with the side walls of the hopper bin throughout dumping movement of the dumping bin relative to the hopper bin.

2. A refuse compacting and transporting system as defined in claim 1, and the gaps between the sloping side walls of the dumping and hopper bins being variable and said deflector plates being substantially triangular and being self-adjusting under the influence of gravity to maintain said wiping engagement with the side walls of the hopper bin.

3. A refuse compacting and transporting system as defined in claim 1, and said depending refuse pusher plate being disposed dependingly at an approximate 45° angle to the bottom wall of the dumping bin and extending somewhat forwardly of the forward end of the dumping bin.

4. A refuse compacting and transporting system as defined in claim 1, and a plurality of longitudinally spaced cradle braces extending across the exteriors of the dumping bin side and bottom walls, a pair of longitudinal spaced parallel support members welded to the bottoms of the cradle braces and including hinge yoke extensions projecting forwardly of the dumping bin, hinge brackets fixed on opposite sides of said compacting unit adjacent to the hinge yoke extensions, and opposite side transverse axis pivot elements hingedly interconnecting said brackets and said hinge yoke extensions substantially forwardly of the rear end of the hopper bin.

5. A refuse compacting and transporting system as defined in claim 1, and said power means comprising a pair of hydraulic cylinders on opposite sides of said apparatus, and brackets secured to opposite sides of the dumping bin and being coupled with rods of said cylinders and being constructed to shield and substantially enclose the ends of said rods with which the brackets are connected.

6. A refuse receiving, dumping and compacting apparatus adapted for coupling with a large capacity refuse transporting receiver, comprising a horizontal axis ram compacting unit forming a base for the apparatus, an open top and open rear end hopper bin on the forward portion of the compacting unit and communicating with a chamber in said compacting unit, an open top and open forward end dumping bin disposed over the rear portion of the compacting unit and hingedly connected thereto through a transverse axis hinge structure adjacent to the top of the compacting unit and somewhat forwardly of the rear open end of the hopper bin, power means to rotate the dumping bin on the transverse axis hinge structure, a depending refuse pusher plate fixed to the bottom of the dumping bin across its forward end and adpated to rotate with the dumping bin around and above the axis of the hinge structure toward and from a refuse pushing position, the dumping and hopper bins having interfitting scissoring upwardly and outwardly sloping side walls which assume nonparallel variably gapped positions during rotation of the dumping bin, and refuse deflector plates hingedly secured to the forward ends of the sloping side walls of the dumping bin and having corresponding edges which are biased into sliding engagement with the interior surfaces of the sloping side walls of the hopper bin during rotation of the dumping bin.

7. A refuse receiving, dumping and compacting apparatus as defined in claim 6, and said transverse axis hinge structure comprising a yoke-type hinge consisting of a pair of support brackets on the side walls of the compacting unit, a pair of yoke arms on the dumping bin extending forwardly thereof and forwardly of said refuse pusher plate, and opposite side pivot elements hingedly interconnecting said brackets and said yoke arms.

* * * * *